US010669807B2

(12) United States Patent
McManus et al.

(10) Patent No.: US 10,669,807 B2
(45) Date of Patent: Jun. 2, 2020

(54) SEAL BLADDER BONDING SLEEVES FOR SUBMERSIBLE WELL PUMP ASSEMBLY

(71) Applicant: Baker Hughes, a GE Company, LLC, Houston, TX (US)

(72) Inventors: David Farnsworth McManus, Tulsa, OK (US); Aron Meyer, Pryor, OK (US); Ryan Semple, Owasso, OK (US); Joseph Scott Thompson, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 144 days.

(21) Appl. No.: 15/973,699

(22) Filed: May 8, 2018

(65) Prior Publication Data

US 2019/0040711 A1 Feb. 7, 2019

Related U.S. Application Data

(60) Provisional application No. 62/541,546, filed on Aug. 4, 2017.

(51) Int. Cl.

| | |
|---|---|
| ***E21B 41/00*** | (2006.01) |
| ***E21B 33/127*** | (2006.01) |
| ***E21B 43/12*** | (2006.01) |
| ***F04B 47/06*** | (2006.01) |
| ***F04D 29/08*** | (2006.01) |
| ***F04D 13/10*** | (2006.01) |

(52) U.S. Cl.

CPC ..... *E21B 33/1277* (2013.01); *E21B 43/128* (2013.01); *F04B 47/06* (2013.01); *F04D 13/10* (2013.01); *F04D 29/086* (2013.01)

(58) Field of Classification Search

CPC .... E21B 33/1277; E21B 43/128; F04B 47/06; F04D 13/10; F04D 29/086

See application file for complete search history.

(56) References Cited

U.S. PATENT DOCUMENTS

| | | | | |
|---|---|---|---|---|
| 4,361,188 | A | 11/1982 | Russell | |
| 5,367,214 | A | 11/1994 | Turner | |
| 6,100,616 | A * | 8/2000 | Heinig | E21B 41/00 310/87 |
| 6,305,753 | B1 | 10/2001 | Rodrigues | |
| 8,246,052 | B1 | 8/2012 | Marvel, III | |
| 8,246,326 | B2 | 8/2012 | Royzen | |
| 8,690,551 | B1 | 4/2014 | Royzen et al. | |
| 9,366,120 | B2 | 6/2016 | Merrill et al. | |
| 9,470,216 | B2 | 10/2016 | Reeves et al. | |
| 10,323,751 | B2 * | 6/2019 | Wang | F16J 15/46 |
| 2014/0202681 | A1 | 7/2014 | Merrill et al. | |

OTHER PUBLICATIONS

International Search Report and Written Opinion dated Oct. 2, 2018 for corresponding PCT/US2018/037752.

* cited by examiner

*Primary Examiner* — Gilbert Y Lee

(74) *Attorney, Agent, or Firm* — Bracewell LLP; James E. Bradley

(57) ABSTRACT

A well pump seal section housing connects between a pump and a motor. Upper and lower retainers at upper and lower ends of the housing have outward facing cylindrical walls. A bladder has an interior in fluid communication with dielectric lubricant in the motor. Rigid upper and lower sleeves are bonded within upper and lower openings of the bladder. The sleeves slide over the cylindrical walls of the retainers and are sealed by seal rings. Fasteners secure the sleeves to the cylindrical walls.

18 Claims, 3 Drawing Sheets

SEAL BLADDER BONDING SLEEVES FOR SUBMERSIBLE WELL PUMP ASSEMBLY

CROSS REFERENCE TO RELATED APPLICATION

This application claims priority to provisional application Ser. No. 62/541,546, filed Aug. 4, 2017.

FIELD OF DISCLOSURE

The present disclosure relates to a seal section or pressure equalizer of a submersible well pump assembly. More specifically, the present disclosure relates to securing the ends of a pressure equalizing bladder by bonding them to sleeves, which in turn are attached to structure in the seal section.

BACKGROUND

Electrical submersible pumps (ESP) are commonly used in hydrocarbon producing wells. An ESP includes a pump driven by an electrical motor. Dielectric lubricant in the motor lubricates motor bearings. A pressure equalizer or seal section has an elastomeric bladder or a metal bellows with an interior in fluid communication the motor lubricant to reduce a pressure differential between the motor lubricant and the wellbore fluid exterior of the motor. Usually, the seal section connects between the motor and the pump.

The elastomeric bag has open upper and lower ends. A guide tube extends through the open ends and secures to retainers on the upper and lower ends of the seal section. A drive shaft sealed at the upper retainer from well fluid locates within the guide tube. The seal is usually a mechanical face seal, which allows slight leakage of well fluid into the upper retainer. A well fluid port in the upper retainer admits well fluid into the housing exterior of the bladder to exert a pressure force against motor lubricant in the interior of the bladder. It is important to minimize well fluid leakage into the interior of the bladder because it could migrate down to the motor.

There are a number of designs used and known to secure the upper and lower ends to the upper and lower retainers. In one past technique, the open ends of the bladder were adhesively bonded to the upper and lower retainers. ESPs must be retrieved periodically for maintenance. Reconditioning a seal section usually involves replacing the bladder. If adhesively bonded, it was difficult to remove them from the retainers, normally requiring at least part of an expensive retainer to be thrown away.

SUMMARY

A submersible, electrical well pump assembly includes a seal section housing for coupling between a motor and a pump of the assembly. The housing has an axis. First and second retainers are axially spaced apart and extend toward each other from first and second ends of the housing, respectively. Each of the first and second retainers has an outward facing cylindrical wall relative to the axis. A bladder has first and second openings on opposite ends. Rigid first and second sleeves are bonded to and within the first and second openings, respectively. The first sleeve receives and secures to the cylindrical wall of the first retainer. The second sleeve receives and secures to the cylindrical wall of the second retainer.

A first seal ring seals between the first sleeve and the cylindrical wall of the first retainer. A second seal ring seals between the second sleeve and the cylindrical wall of second retainer.

In one embodiment, a first retaining ring secures to the cylindrical wall of the first retainer to retain the first sleeve on the first retainer. A second retaining ring secures to the cylindrical wall of the second retainer and retains the second sleeve on the second retainer. The first and second retaining rings are located within an interior of the bladder.

A first shoulder on the first retainer faces in a second direction. A second shoulder on the second retainer faces the first shoulder. The first sleeve has a first end abutting the first shoulder. The first retaining ring abuts a second end of the first sleeve. The second sleeve has a second end abutting the second shoulder. The second retaining ring abuts a first end of the second sleeve.

An outward protruding annular first rib on a second end of the first sleeve is located within an interior of the bladder. An outward protruding annular second rib on a first end of the second sleeve and located within the interior of the bladder.

In a second embodiment, a first set screw extends through the first sleeve into a mating recess on the cylindrical wall of the first retainer. A second set screw that extends through the second sleeve into a mating recess on the cylindrical wall of the second retainer. The first and second set screws are exterior of the bladder.

Figure 1:
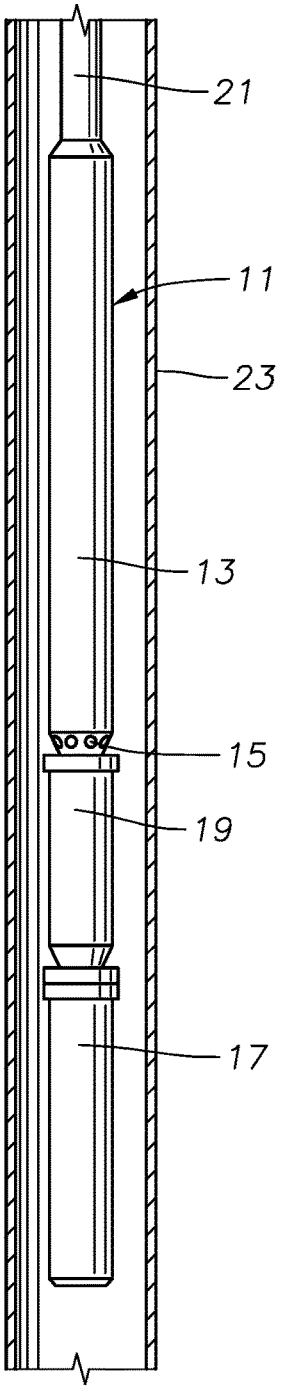
FIG. 1 is an electrical submersible pump having a seal section containing a bladder mounted therein in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates an electrical submersible well pump (ESP) 11 of a type commonly used to lift hydrocarbon production fluids from wells. ESP 11 has a pump 13 that may be a centrifugal, progressing cavity, reciprocating or other type of pump. Pump 13 has an intake 15 for drawing in well fluid. An electrical motor 17 is operatively mounted to and drives pump 13. Motor 17 contains a dielectric lubricant for lubricating the bearings within. A pressure equalizer or seal section 19 communicates with the lubricant in motor 17 for reducing a pressure differential between the lubricant in motor 17 and the exterior well fluid. In this example, seal section 19 locates between motor 17 and pump intake 15. ESP 11 could have other modules between pump 13 and seal section 19, such as a gas separator; in that instance, pump intake 15 would be in the gas separator.

A string of production tubing 21 suspended within casing 23 supports ESP 11. In this example, pump 13 discharges into production tubing 21. Alternately, coiled tubing could support ESP 11, in which case, pump 13 would discharge into the annulus around the coiled tubing. The power cable for motor 17 would be within the coiled tubing instead of alongside production tubing 21.

Figure 2:
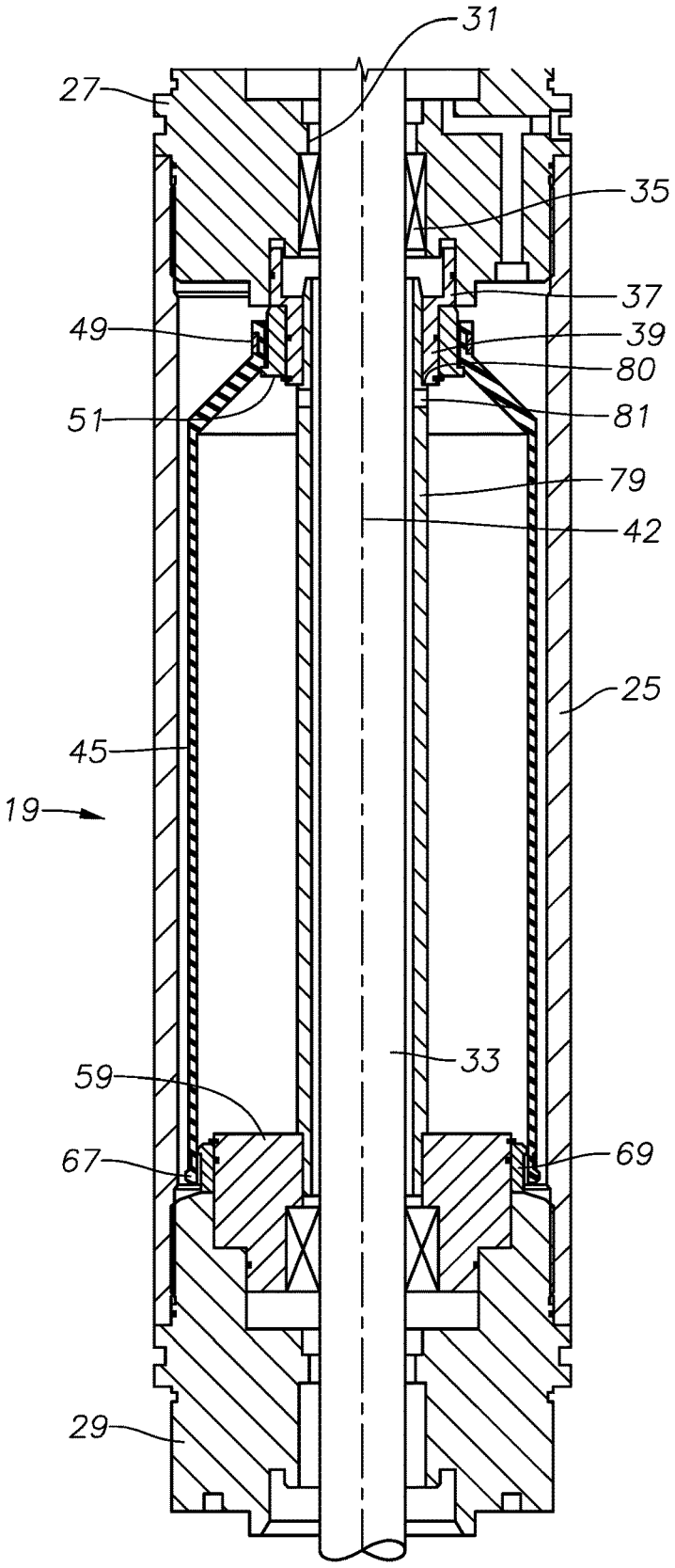
FIG. 2 is a sectional view of the seal section of FIG. 1, showing the bladder mounted in accordance with a first embodiment.

FIG. 2 shows seal section 19 in a partly schematic cross-sectional view. Seal section 19 has a tubular housing 25. An upper connector 27 secures to the upper end of housing 25 and connects seal section 19 to pump intake 15 (FIG. 1) in this embodiment. A lower connector 29 secures to the lower end of housing 25 and connects housing 25 to other components, such as another chamber of seal section 19 or a thrust bearing unit. The terms "upper", "lower" and the like are used only for convenience. ESP 11 could be operated in orientations other than vertical.

Upper and lower connectors 27, 29 have bores 31 through which a rotatable drive shaft 33 extends. Bearings 35, which are shown schematically, support drive shaft 33 in bores 31 but do not seal around drive shaft 33. A seal, normally a mechanical face type (not shown) seals the upper end of shaft 33 to retard the entry of well fluid.

Figure 3:
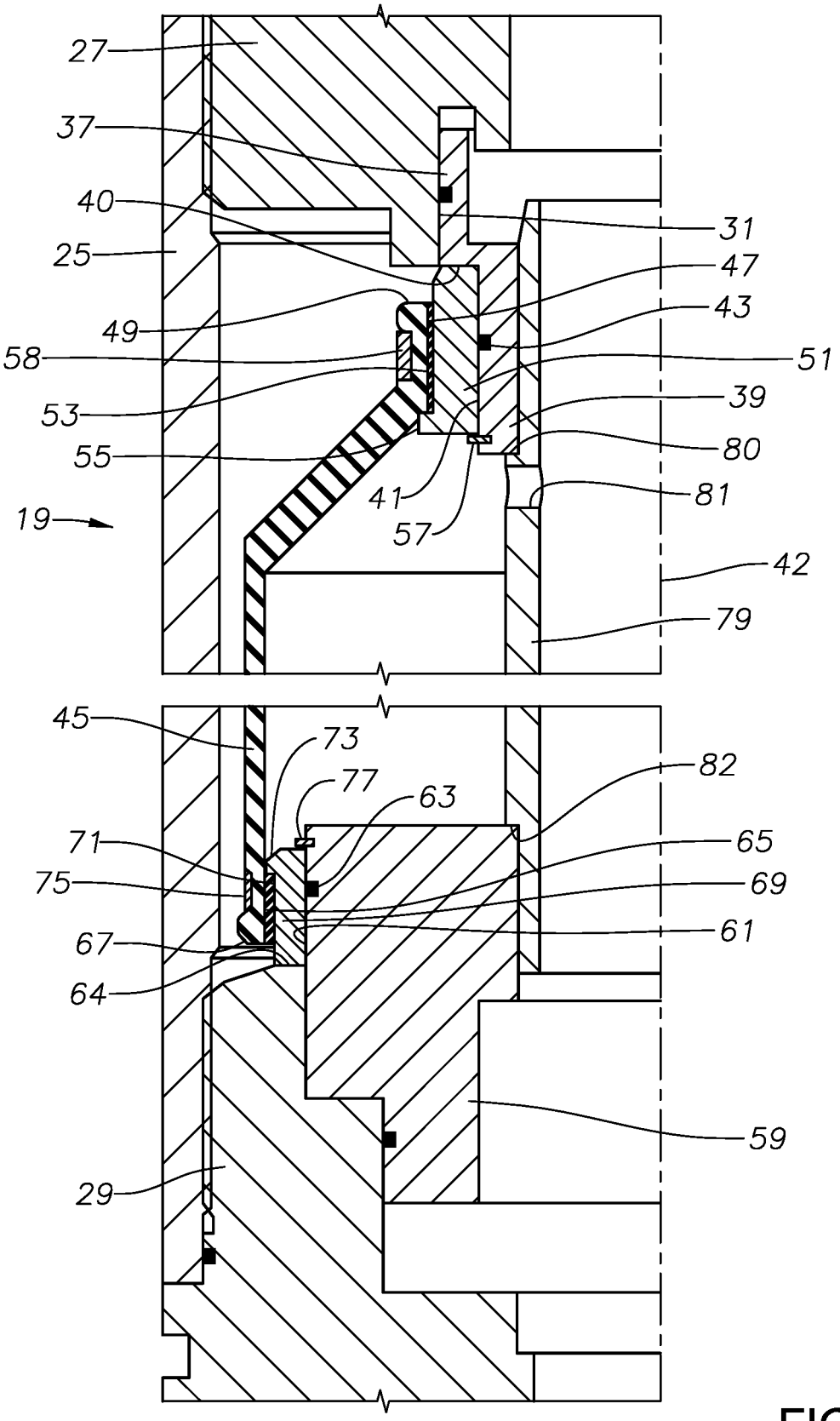
FIG. 3 is a partial, enlarged sectional view of the seal section of FIG. 2.

Referring to FIG. 3, which does not show shaft 33 (FIG. 2), an upper retainer 37, which sealingly inserts into a larger diameter lower portion of bore 31 in upper connector 27. Upper connector 27 may be considered to be a part of upper retainer 37. Upper retainer 37 has a lower portion or neck 39 that extends downward in housing 25 from the lower side of upper connector 27. Neck 39 has an outward facing cylindrical wall 41 relative to a longitudinal axis 42 of housing 25. In this example, cylindrical wall 41 has a smaller outer diameter than the upper portion of upper retainer 37, defining a downward facing shoulder 40. A seal ring 43, which may be an O-ring, encircles and fits within an annular groove on cylindrical wall 41.

A bag or bladder 45 has a circular upper opening 47 at its upper end 49, which is a short cylindrical portion of bladder 45. Bladder 45 is a tubular, flexible member and may be formed of an elastomeric material. Upper end 49 may have a smaller outer diameter than the remaining portions of bladder 45. An upper sleeve 51 inserts closely into upper opening 47. Upper sleeve 51 is a rigid member formed of a material such as of a steel alloy. Upper sleeve 51 bonds within upper opening 47. In this example, an adhesive layer 53, shown schematically, bonds the inner diameter of upper opening 47 to the outer diameter of upper sleeve 51. Adhesive layer 53 may be of a variety of types, including pressure sensitive tape. In this example, upper sleeve 51 has an external flange 55 on its lower end, and the lower end of adhesive layer 53 terminates at external flange 55.

Upper sleeve 51 fits closely around upper retainer cylindrical wall 41 and is sealed to cylindrical wall 41 by seal ring 43. A retaining ring 57, which may be a split, snap ring, engages a groove on cylindrical wall 41 below upper sleeve 51 to prevent upper sleeve 51 from sliding downward off of neck 39. The upper end of upper sleeve 51 abuts or is closely spaced to downward facing shoulder 40 at the upper end of upper retainer neck 39. Retaining ring 57 and downward facing shoulder 40 serve as a fastener to secure upper sleeve 51 to upper retainer 37.

As a backup for adhesive layer 53, an optional clamp 58 extends around bladder upper end 49. Clamp 58 may be a metal strap that is crimped to exert a continuous compressive force on bladder upper end 49 against upper sleeve 51.

A lower retainer 59 has a lower portion that sealingly inserts into bore 31 of lower connector 29. Lower connector 29 may be considered to be part of lower retainer 59. Lower retainer 59 has a cylindrical upper portion that extends upward passed an upper side 64 of lower connector 29. That upper portion has an outward facing cylindrical wall 61 with a seal ring 63 located in a groove encircling cylindrical wall 61.

Bladder 45 has a circular lower opening 65 in a lower end 67. Bladder lower end 67 is cylindrical and may have a larger outer diameter than bladder upper end 49. A lower sleeve 69 inserts into lower opening 65 and is sealed to the inner diameter of bladder lower opening 65 by an adhesive layer 71. Lower sleeve 69 may have an external flange 73 on its upper end above adhesive layer 71. Lower sleeve 69 closely fits over lower retainer cylindrical wall 61 and is sealed by seal ring 63. A clamp 75, which may the same type as clamp 58, may clamp around bladder lower end 67 as a backup for adhesive layer 71. A retaining ring 77 secures to an annular groove in lower retainer cylindrical wall 61 above lower sleeve 69. The lower end of lower sleeve 69 abuts or is closely spaced to connector upper side 64, which serves as an upward facing shoulder to prevent upward movement of lower sleeve 69 on retainer 59. Retaining ring 77 prevents upward movement of lower sleeve 69 on lower retainer 59. Retaining ring 77 and lower retainer shoulder 64 define a fastener for securing lower sleeve 69 to lower retainer 59. Upper and lower retaining rings 57, 77 are located within the interior of bladder 45.

Referring also to FIG. 2, a guide tube 79 extends between upper retainer 37 and lower retainer 59. The upper end of guide tube 79 slides into the inner diameter of upper retainer neck 39. An external upward facing shoulder 80 on guide tube 79 abuts the lower end of upper retainer neck 39. Similarly, the lower end of guide tube 79 slides into the inner diameter of lower retainer 59. A downward facing shoulder 82 on guide tube 79 abuts the upper side of lower retainer 59.

Shaft 33 extends through guide tube 79 and has a smaller diameter than the inner diameter of guide tube 79, creating an annular passage. The annular passage is in communication with lubricant in motor 17 (FIG. 1). Ports 81 near the upper end of guide tube 79 communicate lubricant in motor 17 (FIG. 1) and in guide tube 79 with the interior of bladder 45. A port (not shown) in upper connector 27 admits well fluid to the interior of housing 25 on the exterior of bladder 45. Bladder 45 expands and contracts in response to a pressure difference between the well fluid and the lubricant in motor 17.

In one method of assembly, a technician positions upper and lower sleeves 51, 69 around upper and lower retainers 37, 59 and secures them with retaining rings 57, 77. Guide tube 79 may be installed between upper and lower retainers 37, 59 before or after installing upper and lower sleeves 51, 69. Then, the technician slides bladder 45 lower end 67 and upper end 49 downward over upper retainer 37. He then and slides bladder lower end 67 downward over flange 73 around lower sleeve 69. The technician then bonds bladder lower end 67 to lower sleeve 69 with adhesive layer 71. Then the technician positions bladder upper end 49 around upper sleeve 51 and bonds it with adhesive layer 53. The technician positions the sub assembly of guide tube 79, sleeves 51, 69, bag 45 and retainers 39, 59 in housing 25, stabbing lower retainer 59 into bore 31 in lower connector 29. The technician then secures upper connector 27 to housing 25, causing upper retainer 37 to stab into bore 31 of upper connector 27.

When ESP 11 is retrieved for repair or replacement, technicians may easily disassemble seal section 19 and discard bladder 45 along with upper and lower sleeves 51, 69 still bonded to bladder 45. A new bladder 45 and new upper and lower sleeves 51, 69 may be installed in seal section 19. Because bladder 45 is not bonded to upper and lower retainers 37, 59, upper and lower retainers 37, 59 may be easily re-used. Adhesive layers 53, 71 prevent leakage into or out of bladder 45 better than if clamps 58, 75 are used without adhesive bonding.

Figure 4:
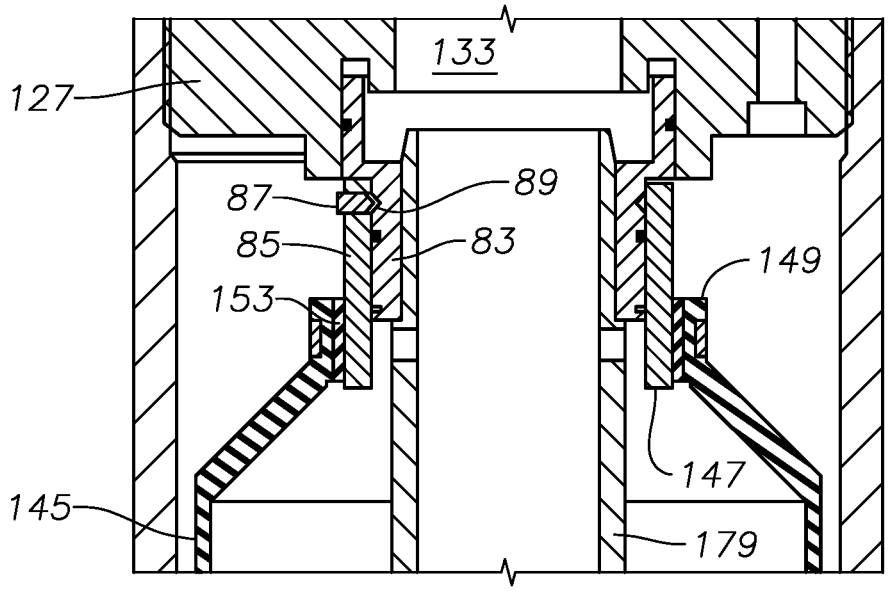
FIG. 4 is a partial, enlarged sectional view of second embodiment of a mounting arrangement for the upper end of the bladder.
Figure 5:
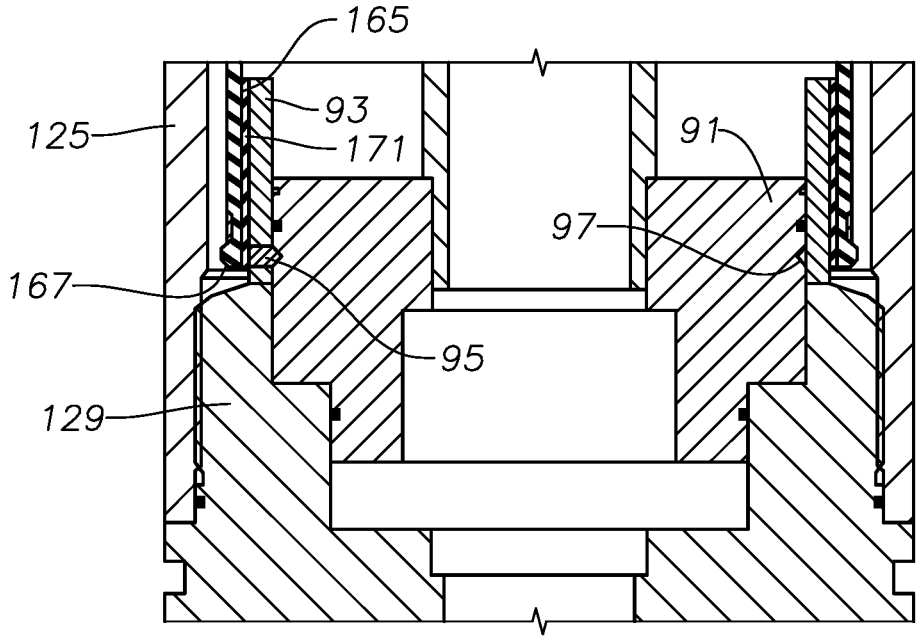
FIG. 5 is a partial, enlarged sectional view of the mounting arrangement for the lower end of the bladder in accordance with the second embodiment.

FIGS. 4 and 5 illustrate another embodiment, and some of the components that are the same as in FIGS. 2 and 3 will not be described again. The components that are mentioned and which are the same as in FIGS. 2 and 3 will have the same reference numeral, except for a prefix. Referring to FIG. 4, upper retainer 83 has an upper sleeve 85 sealingly mounted around it. Unlike the first embodiment, upper sleeve 85 has a lower end that is below upper retainer 83. A set screw 87 extends through the side wall of upper sleeve 85 into engagement with an annular recess 89 extending around the exterior of upper retainer 83. Bladder upper opening 147 bonds to the outer side of upper sleeve 85 with an adhesive layer 153. Set screw 87 is located above bladder upper end 149.

Referring to FIG. 5, lower retainer 91 has a lower sleeve 93 mounted around it. Unlike the first embodiment, lower sleeve 93 has an upper end that is above the upper side of lower retainer 91. A set screw 95 extends through the side wall of lower sleeve 93 into engagement with an annular recess 97 extending around the exterior of lower retainer 91. Bladder lower opening 165 bonds to the outer side of lower sleeve 93 with an adhesive layer 171. Set screw 95 is located below bladder lower end 167.

In the second embodiment, in one method, bladder upper opening 147 will be bonded to upper sleeve 85 before upper sleeve 85 is installed on upper retainer 83. Also, bladder lower opening 165 will be bonded to lower sleeve 93 before it is installed on lower retainer 91. Then, a technician may insert upper retainer 83 into upper sleeve 85 and secure it with set screw 87. The technician inserts lower retainer 91 into lower sleeve 93 and secures it with set screw 95. Both set screws 87, 95 are exterior of the interior of bladder 145.

The subassembly comprising bladder 145, guide tube 179, and upper and lower retainers 83, 91 may then be lowered into housing 125 until lower retainer 91 stabs into lower connector 129. Upper connector 127 may be secured into the upper end of housing 125 with upper retainer 83 stabbing into bore 133.

The present disclosure described herein, therefore, is well adapted to carry out the objects and attain the ends and advantages mentioned, as well as others inherent therein. While two embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A submersible, electrical well pump assembly, comprising:
- a seal section housing for coupling between a motor and a pump of the assembly, the housing having an axis;
- a head secured to a first end of the housing, and a base secured to a second end of the housing;
- first and second retainers mounted to the head and the base, respectively, the first and second retainers being axially spaced apart and extending toward each other from the head and the base, each of the first and second retainers having an axial bore and an outward facing cylindrical wall relative to the axis;
- a bladder having first and second openings on opposite ends;
- rigid first and second sleeves bonded to and within the first and second openings, respectively;
- the first sleeve receiving and secured to the cylindrical wall of the first retainer;
- the second sleeve receiving and secured to the cylindrical wall of the second retainer;
- a guide tube within the bladder and having opposite ends in engagement with the bores in the first and second retainers; and
- a shaft extending through the guide tube and into the bores in the first and second retainers.

2. The assembly according to claim 1, further comprising:
- a first seal ring between the first sleeve and the cylindrical wall of the first retainer; and
- a second seal ring between the second sleeve and the cylindrical wall of second retainer.

3. The assembly according to claim 1, further comprising:
- a first shoulder on the first retainer that faces in a second direction;
- a second shoulder on the second retainer that faces the first shoulder;
- the first sleeve having a first end abutting the first shoulder;
- a first retaining ring abutting a second end of the first sleeve;
- the second sleeve having a second end abutting the second shoulder; and
- a second retaining ring abutting a first end of the second sleeve.

4. The assembly according to claim 1, further comprising:
- an outward protruding annular first rib on a second end of the first sleeve and located within an interior of the bladder; and
- an outward protruding annular second rib on a first end of the second sleeve and located within the interior of the bladder.

5. The assembly according to claim 1, further comprising:
- a first seal ring between the first sleeve and the cylindrical wall of the first retainer;

a second seal ring between the second sleeve and the cylindrical wall of second retainer;

a first set screw that extends through the first sleeve into a mating recess on the cylindrical wall of the first retainer, the first set screw being spaced from the first seal ring in a first direction; and a second set screw that extends through the second sleeve into a mating recess on the cylindrical wall of the second retainer, the second set screw being spaced from the second seal ring in a second direction.

6. A submersible, electrical well pump assembly, comprising:

a seal section housing for coupling between a motor and a pump of the assembly, the housing having an axis;

first and second retainers axially spaced apart and extending toward each other from first and second ends of the housing, respectively, each of the first and second retainers having an outward facing cylindrical wall relative to the axis;

a bladder having first and second openings on opposite ends;

rigid first and second sleeves bonded to and within the first and second openings, respectively;

the first sleeve receiving and secured to the cylindrical wall of the first retainer;

the second sleeve receiving and secured to the cylindrical wall of the second retainer;

a first retaining ring secured to the cylindrical wall of the first retainer and retaining the first sleeve on the first retainer;

a second retaining ring secured to the cylindrical wall of the second retainer and retaining the second sleeve on the second retainer; and wherein the first and second retainers are located within an interior of the bladder.

7. A submersible, electrical well pump assembly, comprising:

a seal section housing for coupling between a motor and a pump of the assembly, the housing having an axis;

first and second retainers axially spaced apart and extending toward each other from first and second ends of the housing, respectively, each of the first and second retainers having an outward facing cylindrical wall relative to the axis;

a bladder having first and second openings on opposite ends;

rigid first and second sleeves bonded to and within the first and second openings, respectively;

the first sleeve receiving and secured to the cylindrical wall of the first retainer;

the second sleeve receiving and secured to the cylindrical wall of the second retainer;

a first set screw that extends through the first sleeve into a mating recess on the cylindrical wall of the first retainer;

a second set screw that extends through the second sleeve into a mating recess on the cylindrical wall of the second retainer; and wherein the first and second set screws are exterior of the bladder.

8. A well pump assembly, comprising:

an electric motor for driving the pump assembly, the motor containing a dielectric lubricant;

a seal section housing connected between the pump and the motor and having a longitudinal axis;

a head secured to an upper end of the housing and a base secured to a lower end of the housing;

upper and lower retainers mounted to the head and the base, respectively, each of the upper and lower retainers having an axial bore and outward facing cylindrical wall, relative to the axis;

a seal ring on each of the cylindrical walls;

a bladder having an interior in fluid communication with the dielectric lubricant in the motor, the bladder having upper and lower ends with upper and lower openings, respectively;

rigid upper and lower sleeves bonded within the upper and lower openings, respectively, the upper sleeve sliding over the cylindrical wall of the upper retainer and being sealed thereto by the seal ring on the cylindrical wall of the upper retainer, the lower sleeve sliding over the cylindrical wall of the lower retainer and being sealed thereto by the seal ring on the cylindrical wall of the lower retainer;

an upper fastener securing the upper sleeve to the cylindrical wall of the upper retainer;

a lower fastener securing the lower sleeve to the cylindrical wall of the lower retainer;

a guide tube within the bladder and having opposite ends in engagement with the bores in the upper and lower retainers; and a shaft extending through the guide tube and into the bores in the upper and lower retainers.

9. The assembly according to claim 8, wherein:

the upper fastener comprises an upper retaining ring secured to the cylindrical wall of the upper retainer below the upper sleeve and the upper end of the bladder; and the lower fastener comprises a lower retaining ring secured to the cylindrical wall of the lower retainer above the lower sleeve and the lower end of the bladder.

10. The assembly according to claim 8, wherein:

the upper retainer has a downward facing shoulder;

the upper fastener comprises an upper retaining ring secured to the cylindrical wall of the upper retainer below the downward facing shoulder, the upper sleeve being located between the downward facing shoulder and the upper retaining ring;

the lower retainer has an upward facing shoulder;

the lower fastener comprises a lower retaining ring secured to the cylindrical wall of the lower retainer above the upward facing shoulder; and the lower sleeve is located between the upward facing shoulder and the lower retaining ring.

11. The assembly according to claim 8, further comprising:

an outward protruding annular rib on a lower end of the upper sleeve and located within an interior of the bladder; and an outward protruding annular rib on an upper end of the lower sleeve and located within the interior of the bladder.

12. The assembly according to claim 8, wherein:

the upper fastener comprises an upper set screw that extends through the upper sleeve into a mating recess on the cylindrical wall of the upper retainer, the upper set screw being above the upper end of the bladder; and the lower fastener comprises a lower set screw that extends through the lower sleeve into a mating recess on the cylindrical wall of the lower retainer, the lower set screw being below the lower end of the bladder.

13. A well pump assembly, comprising:

a pump;

an electric motor containing a dielectric lubricant and operatively coupled to the pump for driving the pump;

a seal section housing connected between the pump and the motor and having a longitudinal axis;

upper and lower retainers at upper and lower ends of the housing, respectively, each of the upper and lower retainers having an axial bore and an outward facing cylindrical wall, relative to the axis;

a seal ring on each of the cylindrical walls;

a bladder having upper and lower ends with upper and lower openings, respectively, the bladder having an interior in fluid communication with the dielectric lubricant in the motor;

rigid upper and lower sleeves adhesively bonded within the upper and lower openings, respectively, the upper sleeve sliding over the cylindrical wall of the upper retainer and being sealed thereto by the seal ring on the cylindrical wall of the upper retainer, the lower sleeve sliding over the cylindrical wall of the lower retainer and being sealed thereto by the seal ring on the cylindrical wall of the lower retainer;

an upper fastener securing the upper sleeve to the cylindrical wall of the upper retainer;

a lower fastener securing the lower sleeve to the cylindrical wall of the lower retainer;

a guide tube within the bladder and having opposite ends in engagement with the bores in the upper and lower retainers; and a shaft extending through the guide tube and into the bores in the upper and lower retainers.

14. The assembly according to claim 13, wherein:

the upper fastener comprises an upper retaining ring secured to the cylindrical wall of the upper retainer below a lower end of the upper sleeve; and the lower fastener comprises a lower retaining ring secured to the cylindrical wall of the lower retainer above an upper end of the lower sleeve.

15. The assembly according to claim 14, further comprising:

a downward facing shoulder on the upper retainer;

an upward facing shoulder on the lower retainer; wherein the upper fastener comprises an upper retaining ring secured to the cylindrical wall of the upper retainer below the downward facing shoulder;

the lower fastener comprises a lower retaining ring secured to the cylindrical wall of the lower retainer above the downward facing shoulder;

the upper sleeve is located between the downward facing shoulder and the upper retaining ring; and the lower sleeve is located between the upward facing shoulder and the lower retaining ring.

16. The assembly according to claim 13, further comprising:

an outward protruding annular rib on a lower end of the upper sleeve; and an outward protruding annular rib on an upper end of the lower sleeve.

17. The assembly according to claim 13, further comprising:

an upper set screw that extends through the upper sleeve into a mating recess on the cylindrical wall of the upper retainer, the upper set screw being above the upper end of the bladder; and a lower set screw that extends through the lower sleeve into a mating recess on the cylindrical wall of the lower retainer, the lower set screw being below the lower end of the bladder.

18. The assembly according to claim 13, further comprising:

an upward facing shoulder on the guide tube that abuts a lower side of the upper retainer; and a downward facing shoulder on the guide tube that abuts an upper side of the lower retainer.

* * * * *